US006166378A

United States Patent [19]

Thomson et al.

[11] Patent Number: 6,166,378

[45] Date of Patent: Dec. 26, 2000

[54] METHOD FOR IMPROVED SIGNAL-TO-NOISE FOR MULTIPLY CHARGED IONS

[75] Inventors: Bruce Thomson, Etobicoke; Igor Chernushevich, North York, both of Canada

[73] Assignee: MDS Inc., Concord, Canada

[21] Appl. No.: 09/081,552

[22] Filed: May 20, 1998

Related U.S. Application Data

[60] Provisional application No. 60/048,182, May 30, 1997.

[51] Int. Cl.[7] ..... H01J 49/26

[52] U.S. Cl. ..... 250/282; 250/281; 250/287

[58] Field of Search ..... 250/282, 281, 250/287

*Primary Examiner*—Bruce C. Anderson
*Assistant Examiner*—Nikita Wells
*Attorney, Agent, or Firm*—Bereskin & Parr

[57] ABSTRACT

A method of improving the signal-to-noise using first and second mass spectrometers in tandem, with an ion detector and data system coupled to the second mass spectrometer, comprising selecting precursor ions with the first mass spectrometer, at least some of the parent ions being multiply charged, colliding or reacting the precursor ions in an intermediate chamber so that multiply charged parent ions produce product ions which have at least one fewer charge than the multiply charged precursor ions, and using the second mass spectrometer or the ion detector and data system to allow only those ions which have an m/z value higher than the multiply charged precursor ions to be recorded for analysis by the ion detector and data system, so that only a signal due to multiply charged precursor ions is obtained in said data system.

8 Claims, 3 Drawing Sheets

METHOD FOR IMPROVED SIGNAL-TO-NOISE FOR MULTIPLY CHARGED IONS

This application claim benefit to provisional application Ser. No. 60/048,182 filing date May 30, 1997.

FIELD OF THE INVENTION

This invention relates to a method for using a triple quadrupole mass spectrometer, or another type of tandem mass spectrometer, to improve the signal-to-noise ratio in the mass spectrum of a sample. The invention has particular application to a mass spectrum produced by electrospray or ion spray. In particular, the method relates to improving the signal-to-noise ("S/N") ratio for multiply charged ions (which are ions containing two or more charges) in the presence of unwanted signal background which consists mainly of singly charged ions.

BACKGROUND OF THE INVENTION

In producing a mass spectrum for a sample, particularly when methods such as electrospray or ion spray are used, there is commonly unwanted background noise. It is always desirable to have the signal level relatively high compared with the background, in order to be able to distinguish the signal. Many approaches, some elaborate and expensive, have been used to achieve this objective.

The inventors have found that when the sample is used to produce multiply charged ions (as commonly occurs in electrospray, ion spray and related techniques), the background consists mainly of singly charged ions. In this situation, using the techniques described below, it is possible to reduce the unwanted background considerably (i.e. to improve the S/N ratio).

BRIEF SUMMARY OF THE INVENTION

In a preferred aspect the present invention provides a method of improving the signal-to-noise using first and second mass spectrometers in tandem, with an ion detector and data system coupled to the second mass spectrometer, comprising selecting precursor ions with the first mass spectrometer, at least some of the precursor ions being multiply charged and having at least a predetermined number of charges, colliding or reacting the precursor ions in an intermediate chamber so that multiply charged precursor ions produce product ions which have at least one fewer charge than the multiply charged precursor ions with the predetermined number of charges, and using the second mass spectrometer or the ion detector and data system to allow only those ions which have an m/z value higher than the multiply charged precursor ions having at least the predetermined number of charges to be recorded for analysis by the ion detector and data system, so that only a signal due to multiply charged precursor ions having at least the predetermined number of charges is obtained in said data system.

Further objects and advantages of the invention will appear from the following description, taken together with the accompanying drawings.

DETAILED DESCRIPTION OF PREFERRED EMBODIMENTS

Figure 1:
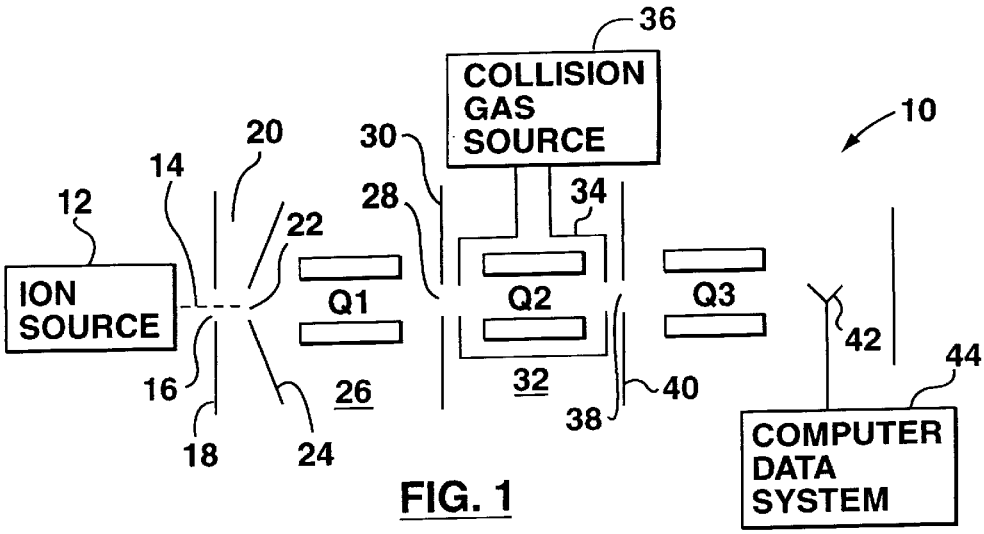
FIG. 1 is a diagrammatic view of a conventional triple mass spectrometer.

Reference is first made to FIG. 1, which shows diagrammatically a conventional triple quadrupole mass spectrometer system 10 with which the invention may be used. (Other mass spectrometer systems may also be used.) As shown, the system 10 includes a sample source 12, which is typically an electrospray source, an ion spray source, or another ion source which produces a multiply charged ion stream 14. The ions 14 are injected through an orifice 16 in an orifice plate 18, through a vacuum chamber 20, and through an orifice 22 in a skimmer 24, into a first quadrupole Q1 located in a vacuum chamber 26. Quadrupole Q1, which has both AC and DC applied to it, acts as a resolving mass spectrometer, transmitting ions having a selected mass to charge (m/z) ratio while rejecting other ions.

Ions which are transmitted through quadrupole Q1 pass through an orifice 28 in an interface plate 30 into another vacuum chamber 32 containing a quadrupole Q2 located in a "can" 34 and arranged to operate as a collision cell. Collision gas at a desired pressure is supplied from collision gas source 36. Normally quadrupole Q2 has RF-only applied thereto (without resolving DC), so that quadrupole Q2 can contain and transmit ions having a wide range of m/z values.

In quadrupole Q2, parent ions fragment by collisions with the collision gas to produce product or daughter ions. Ions emerging from quadrupole Q2 pass through an orifice 38 in an interface plate 40 into a quadrupole Q3 which has both AC and DC applied thereto (again from a source not shown), to act as a resolving quadrupole, transmitting only ions having a selected m/z ratio. The RF and DC applied to Q3 are normally scanned to produce a mass spectrum detected at detector 42 and read by a computer data system 44.

In the method of the invention, advantage is taken of the fact that a multiply charged ion can be fragmented, e.g. in a collision cell, to form at least some product or daughter ions which are less charged, and which have a higher m/z value than the parent ion. An example of such ions are doubly charged peptide ions.

Therefore, if it is desired to detect the presence of a small amount of this doubly charged ion, in the presence of higher levels of singly charged ions (which may be present due to other components in the sample, or due to ions from the solvent used in the sample source 12), then as mass spectrometer Q1 is scanned through a mass range of interest, the ions transmitted through Q1 are fragmented in collision cell Q2, and mass spectrometer Q3, or the data system 44 which is connected to the detector 42, is set to transmit or record only those ions which have a greater m/z value than that which is transmitted by the first mass spectrometer Q1. Ideally, the computer and data system 44 will record a signal which is the sum of the signal-from all ions greater in mass than the precursor or parent ion transmitted through Q1, in order to achieve high sensitivity. The resulting mass spectrum will show mass peaks corresponding only to those ions which have two or more charges, since all ions with only one charge will fragment only to m/z values lower than that of the precursor or parent ion.

Figure 2:
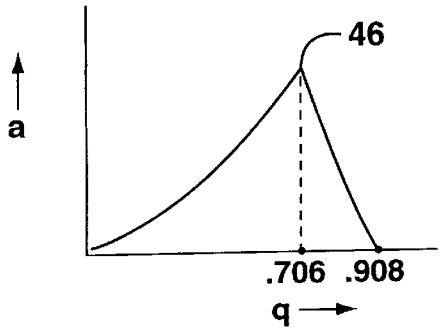
FIG. 2 is a standard quadrupole stability diagram.

This method may be performed using a triple quadrupole, with reference to the standard quadrupole stability diagram as shown in FIG. 2, which plots a on the vertical axis and q on the horizontal axis, where $$a = \frac{8\,eU}{m\Omega^2 r_0^2}$$

$$q = \frac{4\,eV}{m\Omega^2 r_0^2}$$

where e is the electron charge, V is the RF amplitude, U is the DC amplitude, m is the mass of the ion of interest, Ω is the RF frequency (radians/second), and $r_0$ is the inscribed radius of the space within the rods.

When the quadrupole is operated in the resolving mode, the operating line usually is set to pass through the tip 46 of the stability diagram, where q=0.706. Ions having q=0.706 are therefore transmitted, while ions having masses such that their q's are less than or greater than 0.706 are rejected to the rods.

When the quadrupole is operated in RF-only or total ion mode, without DC (so that the operating line is on the q axis), ions having q≧0.908 are rejected to the rods.

Therefore, in one embodiment of the invention, and with reference to FIG. 1, Q1 is operated in a resolving mode; Q2 is operated as a conventional collision cell, and Q3 (which normally would be operated in a resolving mode) is instead operated in a total ion mode (i.e. as an RF-only quadrupole), at an RF level which corresponds to more than 9/7 that of the RF level in Q1 (i.e. at a "q" value greater than 0.908 for masses which were transmitted through Q1). In this mode, Q3 operates as a high pass filter, transmitting only ions which have a greater m/z ratio than those which are transmitted by Q1 (since Q1 is as mentioned operated near the tip of the stability diagram, at about q=0.706). Thus, only fragment ions formed in Q2 which are greater in m/z than the precursor or parent ion will be transmitted through Q3. As the RF (and DC) levels are scanned in Q1 (to transmit ions of different masses), the RF level in Q3 is correspondingly scanned to maintain its amplitude at more than 9/7 that of the RF level in Q1.

An advantage of operating Q3 in a total ion mode is that high sensitivity is achieved, since there are no transmission losses associated with resolving in Q3, and there is no loss in efficiency which would be associated with scanning Q3 over a selected mass range for each Q1 m/z value. By operating Q3 in an RF-only mode, at a fixed ratio (greater than 9/7) compared to Q1, the detector 42 receives only ion signal from ions which have two or more charges (since ions with more than two charges also fragment to produce ions higher in m/z value than the precursor, so that doubly, triply, quadruply, etc. charged ions would all be observed in the spectrum, but singly charged ions would not).

The efficiency of the process described depends on how efficiently each species is fragmented to ions higher in m/z than the precursor. This will vary from one ion species to another, but it is generally true that all multiply charged ions will form at least some higher m/z fragments. Since it is generally true that higher m/z precursors require higher collision energy in order to fragment, the collision energy should be scanned over a defined range as Q1 is scanned through a selected mass range. For example, the collision energy (per single charge) could be scanned upwardly from 30 eV to 100 eV as the precursor or parent ion m/z is scanned from 400 amu to 2000 amu. It is noted that if the collision energy is too low, then the ions in Q2 may not have sufficient energy to fragment, while if the collision energy is too high, then the initial product or daughter ions may fragment further before they leave the collision cell Q2, resulting in predominantly low m/z fragments, which would defeat the purpose. The optimum relationship between m/z and collision energy can be determined empirically. Even though an empirically determined relationship for some classes of compounds will not be optimum for all compounds, it will be preferable to fixing the collision energy for a wide m/z range.

The ideal ratio (R) for the ratio of Q3/Q1 m/z values (RF voltages) is slightly greater than 0.908/0.706=1.286, i.e. preferably R~1.3. This will eliminate transmission of the unfragmented precursor or parent ions through Q3, but will allow transmission of any lower charge state ions which were even only slightly greater in m/z than the precursor ion.

Another way of accomplishing the above-described method is to use the second mass spectrometer Q3 in a mass resolving mode, and only record ion signal from those fragments above the precursor or parent ion mass. While this is not desirable for a triple quadrupole (because for each m/z transmitted by Q1, Q3 would have to be scanned over a significant mass range in order to detect all of the higher m/z ions, and this would be very slow), it is very practical with a tandem mass spectrometer 50 of the kind shown in FIG. 3, where primed reference numerals indicate parts corresponding to those of FIG. 1.

Figure 3:
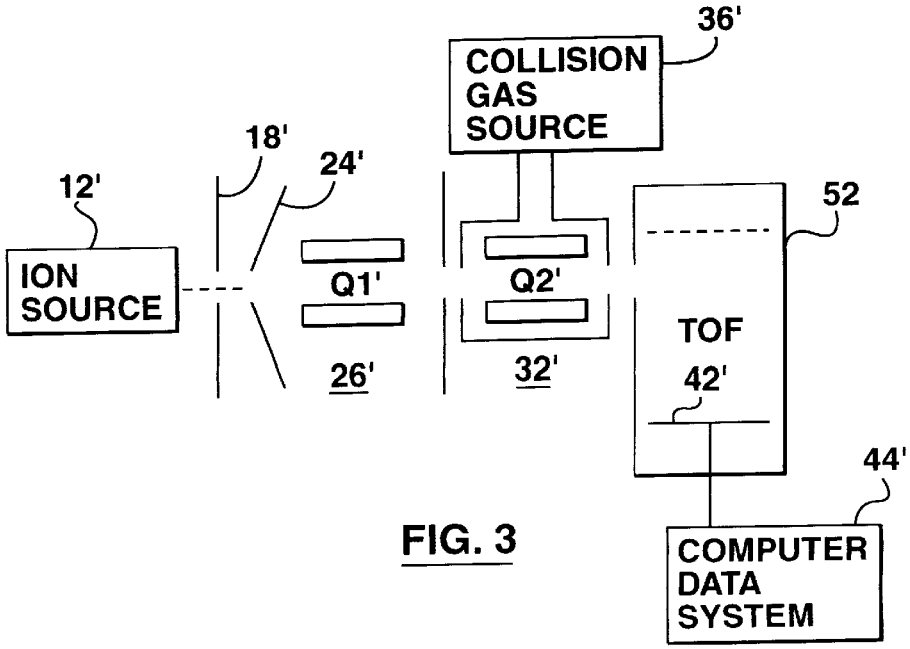
FIG. 3 is a diagrammatic view of a conventional quadrupole/time-of-flight mass spectrometer.

In the mass spectrometer system shown in FIG. 3, the third quadrupole Q3 has been replaced by a time-of-flight (TOF) mass spectrometer 52. In the system 50, TOF spectrometer 52 simultaneously records all of the fragment ions, separated in time. Thus, to record only those ions higher in m/z than the precursor, the computer data system 44' is programmed to record or extract only those ions which are higher in m/z than the precursor, and to produce a spectrum which consists of the sum of intensities of all these ions, via the m/z of the precursor. This method also results in detecting only those ions which form fragments with an m/z value higher than that of the precursor. The same method can be used with a first mass analyzer Q1, collision cell Q2 (or other fragmentation means), and a second mass analyzer consisting of a magnetic sector mass spectrometer and a spatial detector (for example an array detector). In this case, the fragment ions are dispersed in space, and the array detector can be adjusted to detect or record only ions which are greater in m/z than the precursor.

Figure 4A:
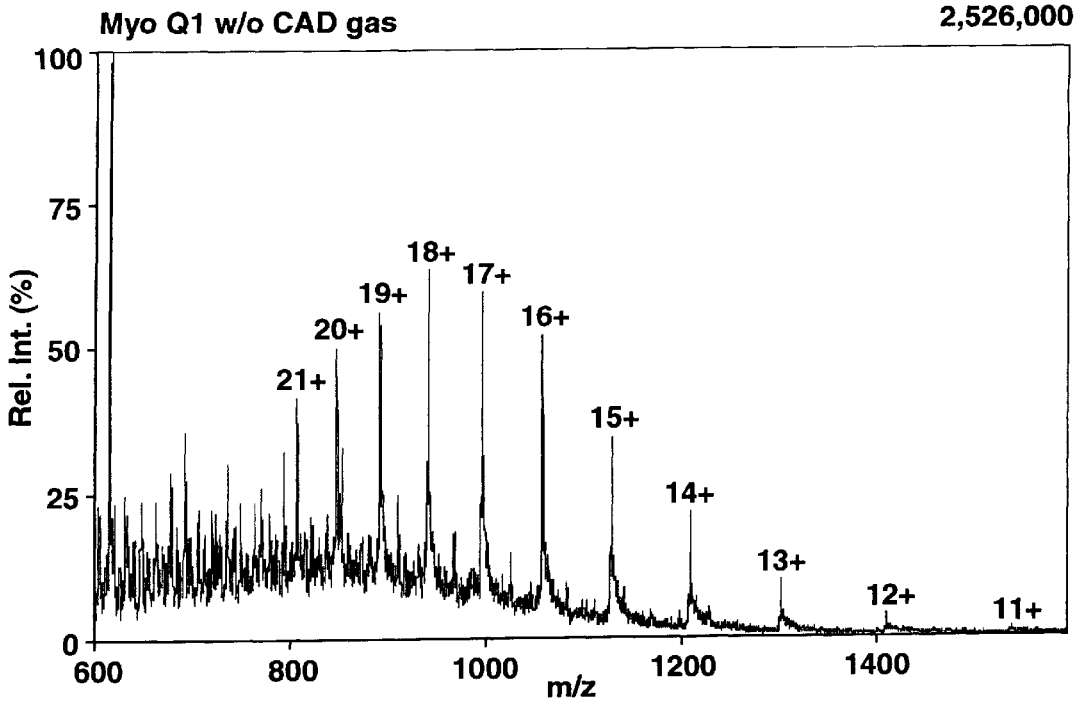
FIG. 4A is a mass spectrum formed by using a portion of the mass spectrometer of FIG. 1.

FIG. 4A shows a mass spectrum (obtained with Q1 of a triple quadrupole such as system 10) of myoglobin, a protein which forms a series of multiply charged peaks 62. The peaks 62 due to myoglobin appear above a background of signal which is of unknown origin but which may be composed of singly charged background ions. Only the peaks from charge state 21 and above are easily distinguishable above the background.

Figure 4B:
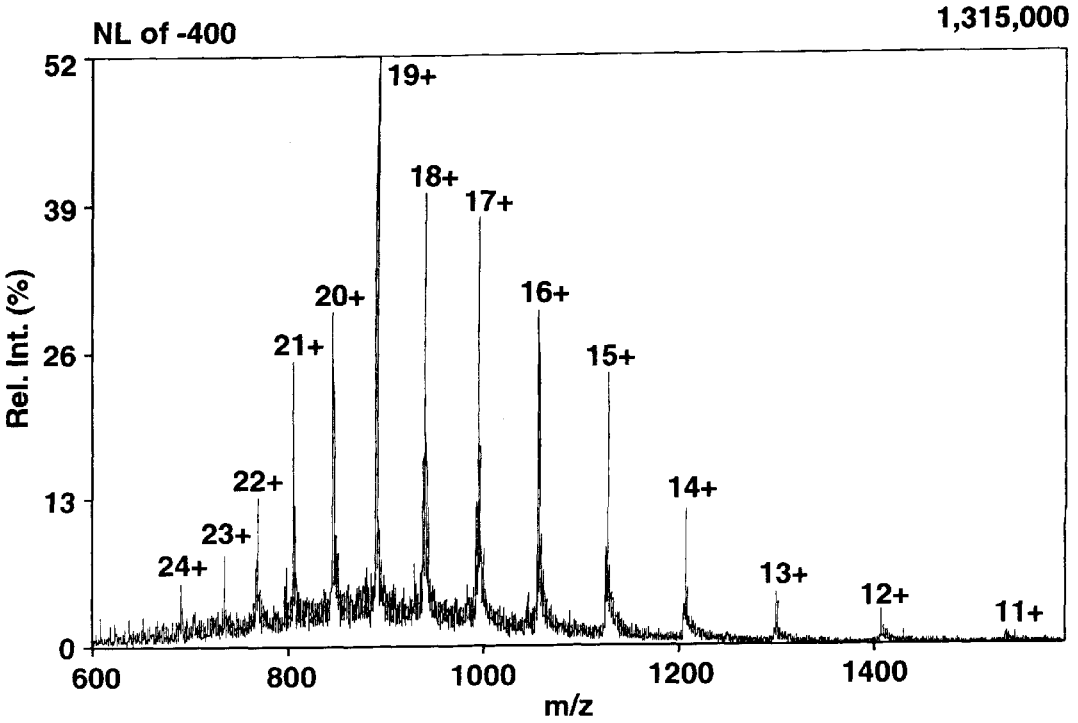
FIG. 4B is a mass spectrum obtained using the method of the invention.

In FIG. 4B, the described method has been applied, by fragmenting ions in Q2, and operating Q3 in an RF-only mode (i.e. a total ion mode) at an m/z value which is 400 amu above that of Q1. Therefore, for all values of m/z less than 1400, the ratio of Q3/Q1 RF voltages (m/z values under normal calibration conditions) is greater than 9/7, and only ions which fragment to an m/z greater than that of the precursor mass will be transmitted through Q3 and detected. Thus all charge states below 12+ are detected due to their fragmentation to ions having higher m/z values. Charge states 12+ and 11+ are transmitted through both Q1 and Q3.

It is clear that the signal-to-noise ratio is better in FIG. 4B than in FIG. 4A, due to removal of a significant portion of the background by the described method. Charge states 24+, 23+ and 22+ are clearly visible in FIG. 4B but not in FIG. 4A. While for this experiment Q1 and Q3 were scanned with a fixed mass value difference of 400 amu, it would be preferable to scan Q3/Q1 in a fixed ratio of greater than 9/7. This was not performed here because the software did not provide that scan method.

If it is desired to detect only ions which have more than two charges, then Q3 can be scanned in a ratio of greater than 2×9/7=2.58 to Q1 (i.e. Q3/Q1>2.58). This will record only signals from ions which fragment to singly charged ions at greater than the m/z of the doubly charged precursor. In general, ions with greater than n charges can be detected while discriminating against ions with a lower number of charges, by operating Q3 at a value of 9n/7 of Q1. However as n increases, the probability of forming a fragment which is 9n/7 higher than the precursor decreases.

Figure 5A:
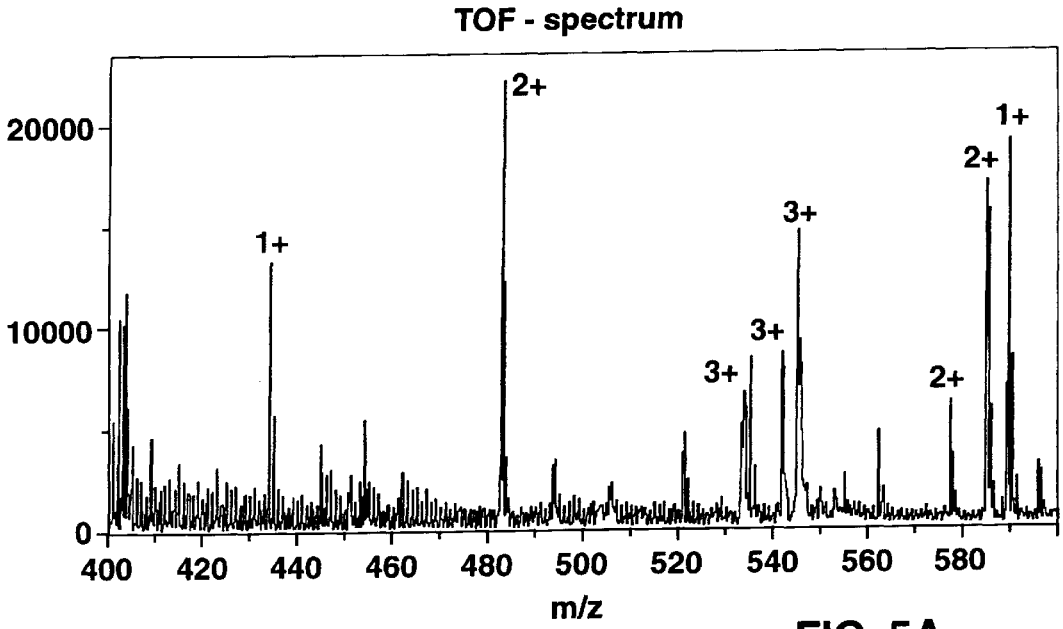
FIG. 5A shows a mass spectrum obtained from a time-of-flight analyzer without fragmentation.
Figure 5B:
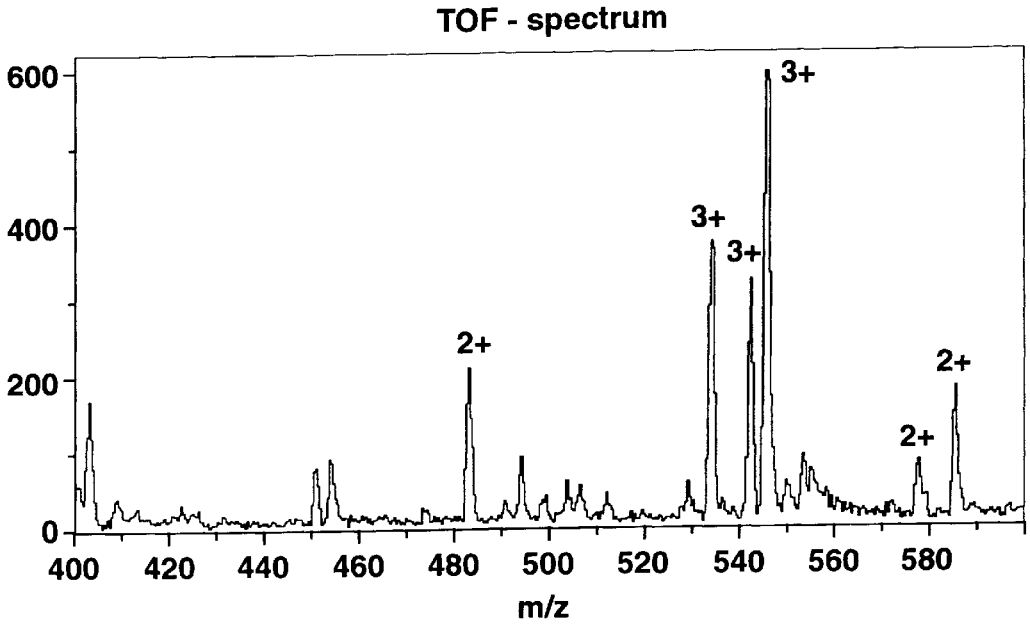
FIG. 5B shows a mass spectrum obtained using the method of the invention.

A second example is shown in FIGS. 5A and 5B. These show spectra 70, 72 which were obtained using the system 50 of FIG. 3, i.e. a quadrupole Q1, a collision cell Q2, and a TOF mass spectrometer 52. The spectrum 70 shows a mixture of peptides from a chemical digestive cytochrome c, a protein. Spectrum 70 was obtained from the TOF analyzer 52 without any fragmentation, and with quadrupole Q1 operated in a conventional RF-only mode. Many peaks appear in the spectrum, some associated with the peptides in the sample, others possibly associated with solvent or buffer or contaminant ions. The peptide ions of interest are usually doubly or triply charged. In fact, it is well known that doubly charged peptide ions fragment in the most predictable fashion to provide sequence information. Therefore it is often desired to detect which of the ions in the spectrum 70 are doubly or triply charged, so that they can be subjected to MS/MS. While the isotope pattern is often sufficient to distinguish the doubly and triply charged ions (doubly charged ions have isotopic peaks spaced 0.5 amu apart, and triply charged species 0.33 amu apart), in many cases the surrounding peaks prevent easy identification in this manner. For example, the first isotopic peak may be completely masked by the peak from a singly charged ion, so that it cannot be determined which is the first peak in the isotopic cluster. If the wrong peak is selected, the calculated mass value could be in error by 1 Da.

In mass spectrum 72 of FIG. 5B, obtained from the same sample by scanning with Q1 in a mass resolving mode, (RF and DC applied), fragmenting the ions in collision cell Q2, and recording only those ions in the TOF spectrum which have m/z values greater than the precursor (the value transmitted through Q1), many of the smaller peaks, as well as the singly charged peaks, from FIG. 4A are absent. Only the doubly and triply charged ions are evident. This demonstrates the benefit of the method in improving the signal-to-noise ratio for multiply charged ions.

The method described can be employed with any combination of mass analyzers, in which the ions are fragmented between the analyzers and the second analyzer is used to detect or distinguish only those species which are greater than a threshold, where the threshold indicates a lower limit on the charge state. In addition, the method can be used to distinguish which ions in a complex spectra are singly charged, or lower than a certain charge state, by comparing the described scan (showing only multiply charged ions) to the full scan to show only the lower charge state ions.

In a related method, higher charge state ions can be reduced in charge state by allowing them to react in the collision cell Q2 with neutral species which will acquire one or more charges from the ion. For example, a low concentration of water vapor, or methanol vapor, or another gas-phase base, may be added to the collision gas. At low entrance energy, multiply charged ions may react by transferring one or more charges to the neutral molecule. This effectively increases the m/z of the ion. Thus, in the same way as described above, the second mass analyzer (Q3 or the TOF for example) can be used to detect only those ions which react to generate products which are higher in m/z than the precursor.

Another method of accomplishing the described effect is to operate the collision cell at an RF level which is slightly higher than 9/7 of the RF level of Q1. Only fragment ions formed in the collision cell through reaction or fragmentation which are higher in m/z than the precursor ion will then be stable and will be transmitted to the TOF analyzer or to Q3. The precursor plus lower m/z fragments will be unstable and thus will be rejected by the collision cell. This removes the requirement for using the computer data system 44 to sum all of the ions greater than the precursor m/z value. Since the energy of precursor ions entering the collision cell is high, the precursor will penetrate to a sufficient distance to accomplish a few collisions before being rejected from the cell due to instability. Therefore, multiply charged ions which fragment or react close to the entrance of the collision cell, and which form ions higher in m/z value than the precursor ion, will be detected by measuring the total ion current from the TOF analyzer, or by measuring the ion current after the collision cell Q2.

While preferred embodiments of the invention have been described, it will be realized that various changes may be made within the scope of the invention.

We claim:

1. A method of improving the signal-to-noise using first and second mass spectrometers in tandem, with an ion detector and data system coupled to the second mass spectrometer, comprising selecting precursor ions with the first mass spectrometer, at least some of the precursor ions being multiply charged and having at least a predetermined number of charges, colliding or reacting the precursor ions in an intermediate chamber so that multiply charged precursor ions produce product ions which have at least one fewer charge than the multiply charged precursor ions with the predetermined number of charges, and using the second mass spectrometer or the ion detector and data system to allow only those ions which have an m/z value higher than the multiply charged precursor ions having at least the predetermined number of charges to be recorded for analysis by the ion detector and data system, so that only a signal due to multiply charged precursor ions having at least the predetermined number of charges is obtained in said data system.

2. A method according to claim 1 in which the second mass spectrometer is a quadrupole mass filter operated in an RF-only mode so that only ions above a selected cut-off mass are transmitted therethrough to said detector, said cut-off mass being defined by the edge of the stability diagram at q=0.908 for the precursor ion.

3. A method according to claim 1 in which the second mass spectrometer is a time-of-flight mass spectrometer having a data system, which can simultaneously record all product ions, and wherein said data system is programmed to only record ions which are greater in m/z than the precursor ions.

4. A method according to claim 1 in which the intermediate chamber is a collision cell comprising an RF quadrupole or multipole, having an RF voltage applied thereto, with the RF voltage adjusted so that only fragment ions higher in m/z than said precursor ions are stable therein.

5. A method according to claim 2 in which at least some of the precursor ions are singly charged, and said second mass spectrometer is operated at an RF voltage such that the ratio of the RF voltage of said second mass spectrometer to the RF voltage of said first mass spectrometer is slightly greater than 0.908/0.706, whereby, at least some product ions produced from said singly charged ions are not transmitted through said second mass spectrometer.

6. A method according to claim 5 in which the ratio is preferably about 1.3.

7. A method according to claim 2 in which said second mass spectrometer is operated at an RF voltage such that the ratio of the RF voltage of said second mass spectrometer to the RF voltage of said first spectrometer is slightly greater than 0.908n/0.706, n being an integer greater than 1, whereby, at least some product ions produced from ions having n or less charges are not transmitted through said second mass spectrometer.

8. A method according to claim 7 in which the ratio is preferably about 1.3n.

* * * * *